United States Patent [19]

Donovan et al.

[11] 3,935,852

[45] Feb. 3, 1976

[54] SPARK PLUG CONNECTOR AND IGNITION COIL MODULE FOR ENGINE IGNITION SYSTEM

[75] Inventors: John J. Donovan, West Springfield; Daniel R. Isham, Hampden, both of Mass.

[73] Assignee: R. E. Phelon Company, Inc., East Longmeadow, Mass.

[22] Filed: May 20, 1974

[21] Appl. No.: 471,806

[52] U.S. Cl. 123/148 A; 123/169 PA; 123/169 PH

[51] Int. Cl.[2] ..... F02P 11/00

[58] Field of Search.... 123/169 PA, 169 PH, 169 P, 123/148 A, 148 D, 195 C, 198 E

[56] References Cited

UNITED STATES PATENTS

| | | | |
|---|---|---|---|
| 995,400 | 6/1911 | Cavanagh | 123/148 A |
| 1,011,884 | 12/1911 | Cavanagh | 123/148 A |
| 3,716,038 | 2/1973 | Bevacqua | 123/148 A |

FOREIGN PATENTS OR APPLICATIONS

| | | | |
|---|---|---|---|
| 1,232,399 | 1/1967 | Germany | 123/169 PA |

*Primary Examiner*—Wendell E. Burns
*Assistant Examiner*—Tony Argenbright
*Attorney, Agent, or Firm*—McCormick, Paulding & Huber

[57] ABSTRACT

A module for use in the ignition system of a spark ignited engine combines in one unit a spark plug connector or cap and an ignition coil for converting low voltage current changes into the high voltage pulses required for firing the associated plug, the module, therefore, eliminating the need for a separate high-tension conductor of substantial length between the ignition coil and the spark plug. The module is mounted to an engine shroud directly outboard of the spark plug so as to electrically cooperate with the plug while nevertheless not relying on the plug for its structural support.

11 Claims, 15 Drawing Figures

SPARK PLUG CONNECTOR AND IGNITION COIL MODULE FOR ENGINE IGNITION SYSTEM

BACKGROUND OF THE INVENTION

This invention relates to ignition systems for spark ignited internal combustion engines, and deals more particularly with a module, for use in such a system, comprising a combined spark plug connector and ignition coil.

The module of this invention is intended for use with ignition systems of the well known type wherein high voltage pulses for firing an associated spark plug are produced by an ignition coil having a primary winding and a secondary winding, each high voltage pulse being produced as a result of a sudden change in the current flowing through the primary winding to induce the high voltage pulse in the secondary winding. In one form of such system, the current change in the primary winding is produced by a set of breaker points which first close to establish a current path through the primary winding and then open to interrupt such path. In another form of system, the current change in the primary winding is produced by suddenly discharging a condenser through such winding. The module may also be used with various different types of engines, but is particularly well adapted for use with relatively small single cylinder, distributorless engines of the type commonly used in chain saws, lawn mowers, snow blowers and the like.

In the past, it has been common to mount an ignition coil at some distance from the spark plug with which it is used and to connect the high voltage output of the coil to the plug by a heavily insulated conductor, the conductor often having a snap-fit connection at one end with the ignition coil at its other end carrying a spark plug cap adapted to fit over the outer end of the spark plug and to make electrical connection therewith. The use of such high tension conductors has several disadvantages, including breakage, loss of electrical energy in the conductor, safety hazard and expense; and, one of the objects of this invention is to eliminate the need for such a high tension conductor by locating the ignition coil directly adjacent the spark plug with which it is used.

As evidenced by prior U.S. Pat. No. 995,400, it is not unknown to combine an ignition coil with a spark plug connector. The arrangements provided in the past, however, have apparently not met with wide acceptance; and, another object of the invention is to provide a spark plug connector and ignition coil module which is an improvement over somewhat similar devices proposed in the past, the improvements residing, among other things, in simplified construction and mounting means. The mounting means for the module is such as to provide separate mounting of the module to parts other than the spark plug while also yielding a good water proof seal between the module and the spark plug and enabling easy removal and replacement of the module to gain access to the plug when necessary.

SUMMARY OF THE INVENTION

The invention resides in an ignition module combining in one unit a spark plug connector or cap and an ignition coil, and more particularly in the manner in which the module is constructed and support when in use. As to its construction, the module includes a cup-shaped housing defining a two-lobed recess. The recess in turn receives a subassembly made up of an ignition coil and a generally cylindrical well member, the interior of which well member defines a socket or recess for receiving the outer end of the associated spark plug. The coil fits into one of the lobes of the housing recess and the well member into the other lobe. A potting material holds both the ignition coil and the well member rigidly in place in the housing. The construction of the well member is such that during the potting process, the potting material cannot enter the interior of the well member, therefore assuring that the interior is left empty to define the spark plug receiving socket.

As to the mounting of the module, the equipment of which the engine is a part includes an engine shroud or other stationary structure located outwardly of the engine in the vicinity of the spark plug and has an opening through which the spark plug passes when being assembled with or disassembled from the engine. The module is in removably attached to the shroud in the vicinity of the opening so that the spark plug receiving socket thereof fits over the outer end of the plug and makes electrical connection with the high tension terminal of the plug. The module is readily removable from the engine shroud and when removed provides easy access to the plug to allow the plug to be removed from the engine.

DETAILED DESCRIPTION OF THE PREFERRED EMBODIMENTS

Figure 1:
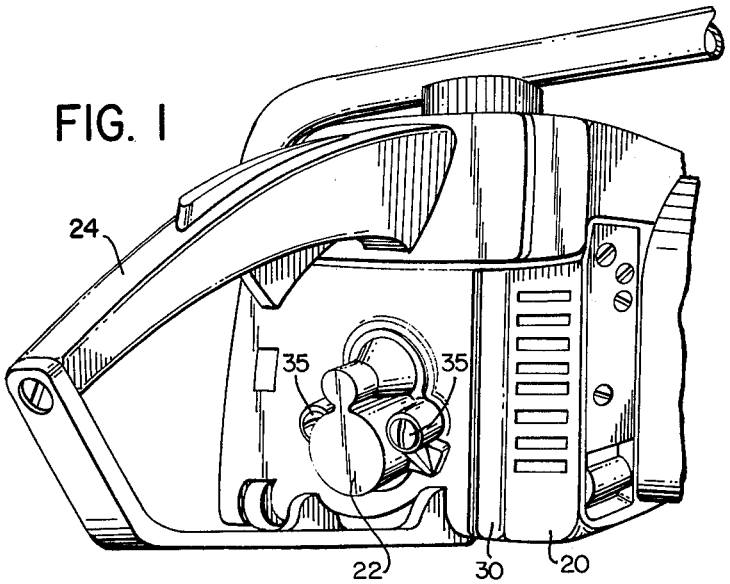
FIG. 1 is a perspective view showing the rear end of a chain saw having an ignition module embodying this invention.
Figure 2:
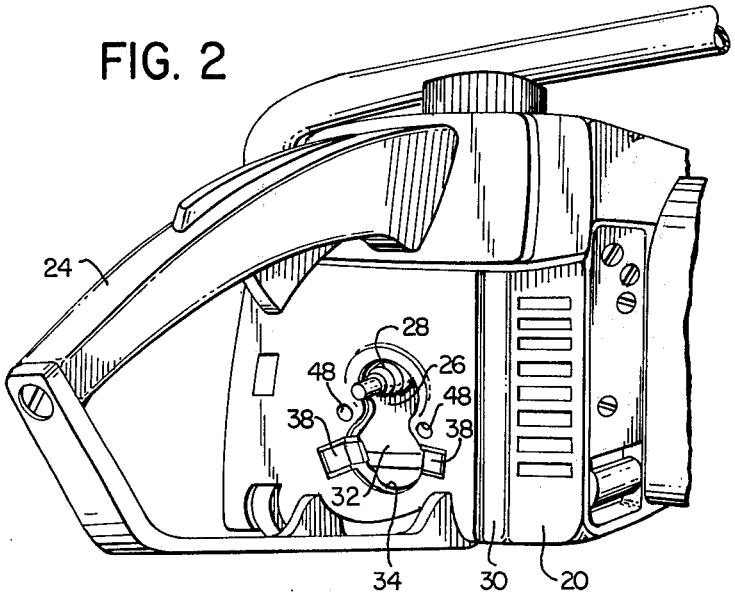
FIG. 2 is a view similar to FIG. 1 except that it shows the chain saw with the ignition module removed therefrom.

Referring first to FIGS. 1 and 2, these figures show the rear end of a chain saw 20 having an ignition module 22 embodying this invention, the module 22 in this case being conveniently located within the space surrounded by the rear handle 24 of the saw so as to be protected to some extent against accidental blows by the handle structure. The saw includes a single cylinder internal combustion engine 26, seen partially in FIG. 2, having a spark plug 28 arranged generally horizontally, when the saw is in the position shown, and extending rearwardly from the remainder of the engine. The rear end of the engine is enclosed by an engine shroud or case 30 fixed to the frame of the saw. The engine shroud is spaced some distance from the engine and, as seen in FIG. 2, includes an opening 32 in the vicinity of the plug 28 to provide access to the plug when the module 22 is removed from the saw. The outer end of the plug 28 projects through the shroud opening 32 and the module 22 is fixed to the shroud so as to be supported therefrom, the module therefore not relying on the plug 28 for support and not imposing any significant loads on the plug. As seen in FIG. 2, a connector assembly 34 is fitted with the engine shroud along the lower margin of the opening 32 for cooperation with screws 35, 35 in removably fixing the module to the shroud and in making electrical contacts as hereinafter described.

Figures 3, 4, 5:
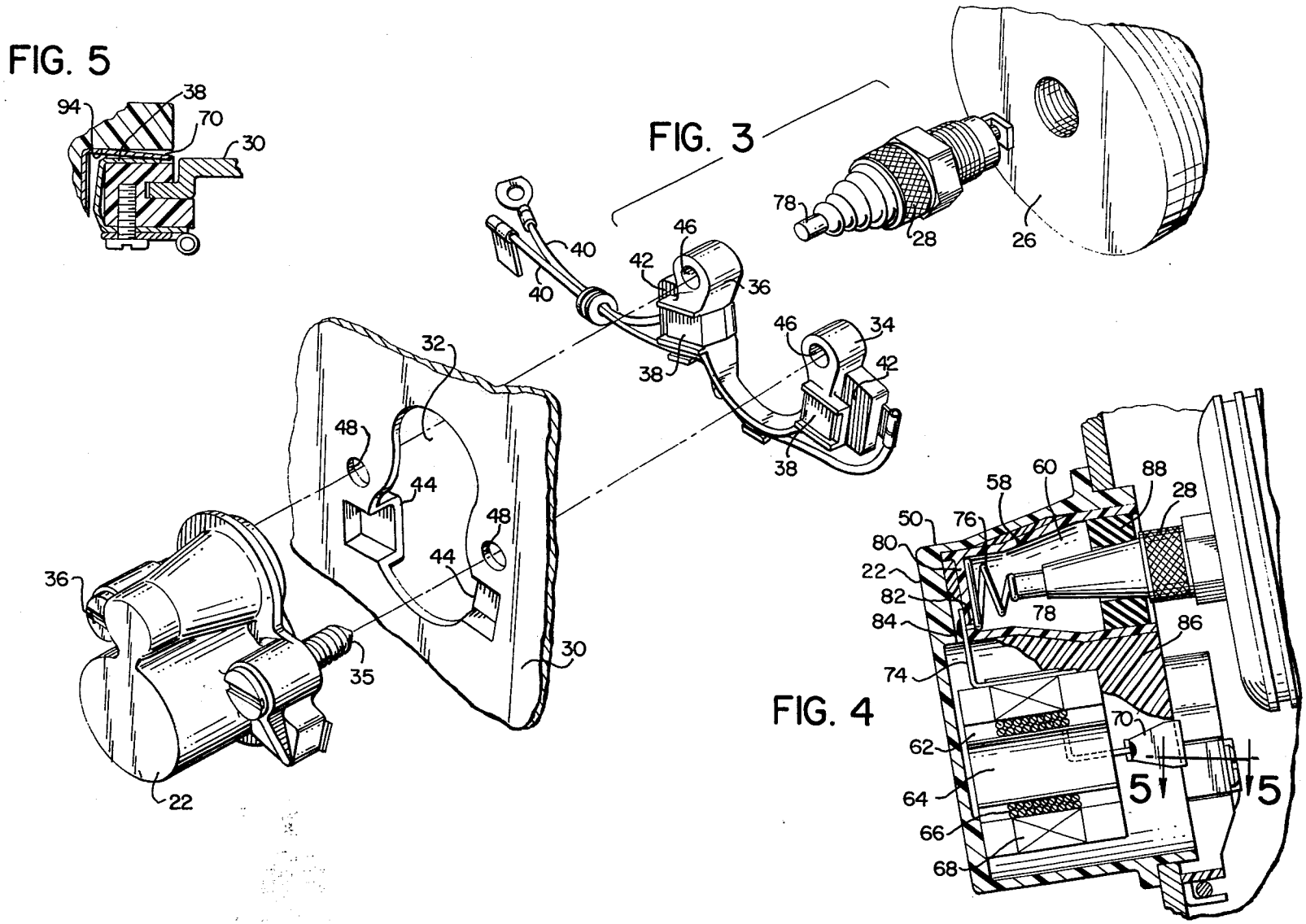
FIG. 3 is an exploded perspective view showing the manner in which the ignition module and related parts of FIG. 1 are assembled with one another.
FIG. 4 is a vertical sectional view taken through the ignition module of FIG. 1 on a vertical plane containing the axis of the spark plug.
FIG. 5 is a fragmentary sectional view taken generally on the line 5—5 of FIG. 4 showing the module in a slightly loosened position relative to the engine shroud.

The connector assembly 34 is best shown in the exploded perspective view of FIG. 3. Referring to this figure, the assembly 34 includes a U-shaped body 36 made of an electrical insulating material, preferably a molded plastic. Attached to the body 36 are two electrical contacts 38, 38 to which are respectively connected two leads 40, 40. Behind each contact 38 the body 36 includes a laterally extending recess 42. The engine shroud 30 along the edge of the opening 32 includes two forwardly displaced portions 44, 44. When the assembly 34 is in place with the engine shroud 30, the two recesses 42, 42 thereof respectively receive the two forwardly displaced portions 44, 44 of the engine shroud. Therefore, it will be understood that when the connector assembly 34 is in place, the two contacts 38, 38 will be exposed from the outside of the shroud 30 while the remainder of the connector assembly 34 will be located behind the shroud. The body 36 is sufficiently flexible that its legs may be pressed by hand toward one another to permit assembly with the shroud.

The body 36 of the connector assembly also includes two openings 46, 46 which align with matching openings 48, 48 in the engine shroud to accommodate the screws 35, 35. The screws 35, 35 are preferably designed to be held captive by the module 22 to prevent their possible loss when the module is removed from the saw. They are also preferably self-tapping screws which tap threads in the openings 46, 46 of the connector body the first time the module 22 is assembled with the connector. In any event, it will be understood that the openings 46, 46 of the connector are threaded, either by prior tapping or by self-tapping action of the screws 35, 35, so that when the screws are passed through the shroud openings 48, 48 and threaded into the connector openings 46, 46, the module will be drawn into tight assembly with the engine shroud.

Figure 6:
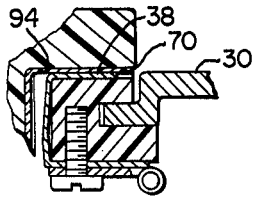
FIG. 6 is a view similar to FIG. 5 but shows the module in its final or tightened position relative to the engine shroud.
Figure 7:
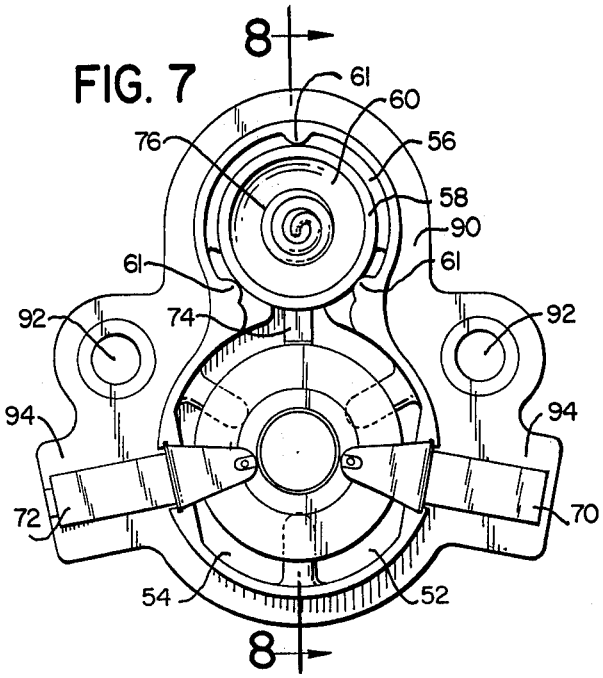
FIG. 7 is a bottom view of the ignition module of FIG. 1 prior to the application of potting material thereto.
Figure 8:
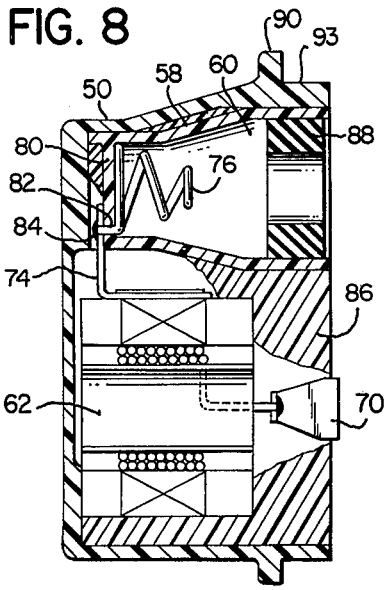
FIG. 8 is a sectional view taken on the line 8—8 of FIG. 7 with the potting material being included.
Figure 9:
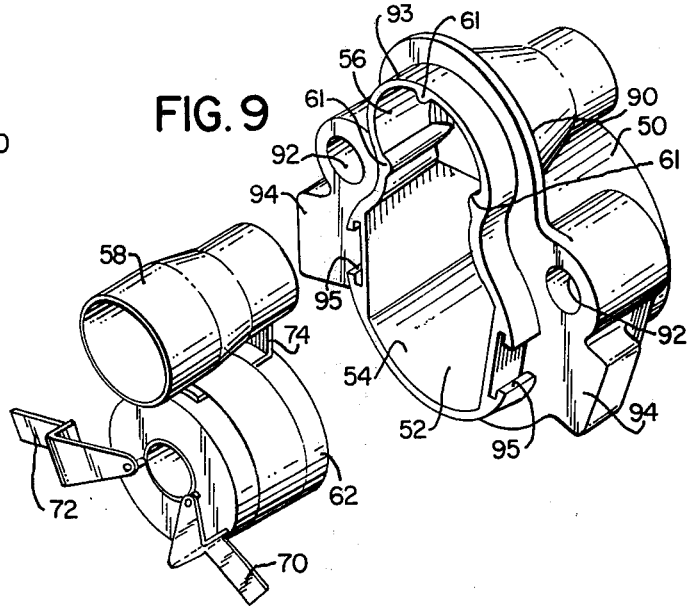
FIG. 9 is an exploded perspective view showing the housing of the module of FIG. 1 and the subassembly which is fitted into the housing in the course of manufacturing the module.

For further details of the construction of the module 22 itself, reference is now made to FIGS. 4 to 9. As shown in these figures, the module includes a generally cup-shaped housing 50 made of an electrical insulating material, preferably a molded plastic. This housing defines a two-lobed or figure-eight shaped recess 52 having a larger lobe 54 and a smaller lobe 56. The smaller lobe 56 receives a well member 58, separate from the housing 50, of generally cylindrical shape, the interior of which defines a recess or socket 60 for receiving the outer end of the associated spark plug 28. As best seen in FIGS. 7 and 9, the housing includes three angularly spaced ribs 61, 61 arranged perpendicular to the plane of the recess opening which engage the outer surface of the well member to hold it in a fixed position relative to the housing. The larger recess lobe 54 receives an ignition coil 62. The coil 62 is of generally conventional construction and includes a core 64 of magnetic material on which is received a primary winding 66 and a secondary winding 68. The core 64 of the coil is oriented parallel with the axis of the well member 58 and both are perpendicular to the plane of the recess opening.

As seen best in FIGS. 7 and 9, the module includes two electrical contacts 70 and 72 which extend laterally outwardly from the recess lobe 54. One of these contacts, for example the contact 70, is a ground contact which is connected both to one side of the primary winding 66 and to one side of the secondary winding 68. The other contact 72 is connected to the opposite end of the primary winding 66. The other end of the secondary winding 68 is connected by a short L-shaped strip 74 of conductive material to a contact spring 76 located in the socket 60 provided by the well member 58 at the inside end of the socket. The contact spring 76 in turn serves to make electrical contact with the high tension terminal 78 of the spark plug 28 when the module 22 is in place as shown in FIG. 4.

Still referring to FIG. 4, the well member 58 is closed at its inside end by an end wall 80 spaced slightly from the housing 50 to accommodate the conductor strip 74 which is located behind the wall 80. The wall 80 is imperforate except for a small opening through which one end 82 of the contact spring 76 extends. The contact strip is mechanically and electrically connected to the contact spring by a drop of solder 84 which effectively closes the opening in the wall 80 through which the spring end 82 passes. In the completed module 22, the well member 58 and ignition coil 60 are held rigidly in place in the housing 52 by a potting material 86. The potting step is preferably performed by pouring a hardenable liquid potting material into the housing recess 52 after the well member and coil subassembly is placed therein, and during this step the sealing of the opening in the bottom wall 80 of the well member by the strip 74 and solder 84 prevents the potting material from entering the socket 60 thereby causing the socket to remain free of potting material as is desired. Also, the socket 60 is fitted with a resilient ring 88, of neoprene or the like, which engages the insulator portion of the spark plug 28 as shown in FIG. 4 to provide a seal preventing the entry of moisture to the interior of the socket 60.

The housing 50 of the module includes a laterally outwardly extending flange 90 including two openings 92, 92 for accommodating the screws 35, 35. The flange also provides two extended flat areas, indicated generally at 94, 94, backing up the two contacts 70 and 72. The flange 90 is spaced a slight distance from the plane of the recess 54 to provide a short skirt 93 shown best in FIG. 9. The skirt 93 has an outside contour closely conforming to the shape of the opening 32 in the engine shroud 30 so as to serve as an aid in locating the module relative to the shroud, the skirt 93 extending through the opening 32 when the module is in place. Also, the skirt 93 includes two notches 95, 95 which respectively receive parts of the contacts 70 and 72 to aid in mechanically holding the contacts in place relative to the housing.

FIG. 9 shows the housing 50 of the module separate from the well member 58 and ignition coil 62. From this figure, it will be understood that the well member 58, the ignition coil 62, the high tension connector strip 74 and the two contacts 70 and 72 form a subassembly which may be completely assembled and fabricated apart from the housing 50 with the completion of the module 22 requiring merely the placement of such subassembly to the housing. 50 followed by a potting of the subassembly to the housing.

The contacts 38, 38 on the connector assembly 34 and the contacts 70 and 72 on the module 22 serve as a means for automatically making electrical connection with the module 22 as the module is assembled with the engine shroud 30. That is, as the module 22 is moved into place, the two contacts 70 and 72 thereof engage the two contacts 38, 38. Preferably, as shown in FIGS. 5 and 6, each contact is made of a relatively resilient material and the free end thereof is, in its relaxed position, displaced a slight distance from its backup surface, as shown in FIG. 5. FIG. 5 illustrates the position of two mating contacts as they first make contact with one another during movement of the module 22 toward its fully assembled position. FIG. 6 shows the same contacts after the module has been moved to its final position by tightening of the screws 35, 35. Therefore, in the final position, the two contacts 38 and 70, as are also the other two contacts 38 and 72, are held against one another by a spring force which assures a good electrical contact.

Figure 10:
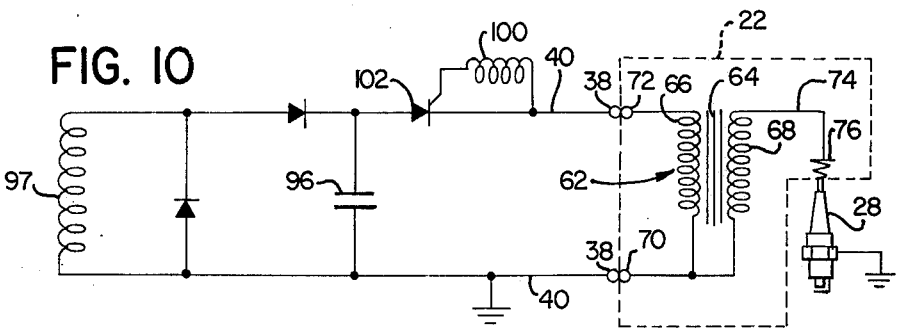
FIG. 10 is a schematic wiring diagram illustrating an ignition system utilizing the ignition module of FIG. 1.

FIG. 10 shows the electrical system for the chain saw 20 if FIG. 2. In this case, the illustrated system is a capacitor discharge system. As mentioned previously, however, the module 22 is not limited to use with such a system but may be used with other types of systems as well. Referring to FIG. 10, the module is represented by the broken line box 22. The system further, as is conventional, includes a charging coil 97 in which a charging voltage is induced by a rotating magnet and which charges an associated capacitor 96. A trigger coil 100, influenced by the same or another rotating magnet, produces a trigger signal for a silicon controlled rectifier 102 which controls discharge of the condenser 96 through the primary winding 66 of the ignition coil 62. Each time such discharge occurs, the sudden change in current through the primary winding induces a high voltage output in the secondary winding 68 which fires the plug 28.

Figure 11:
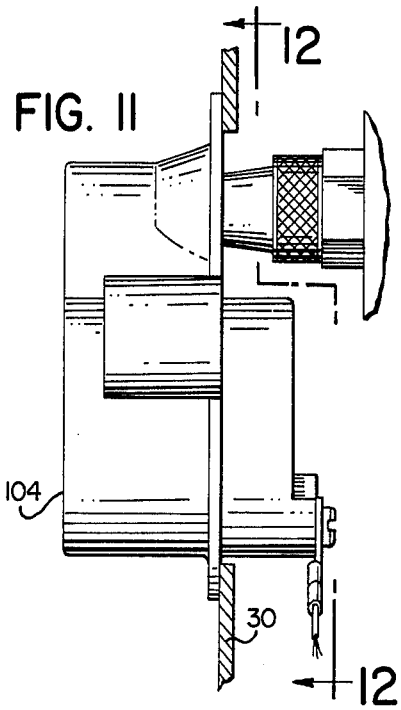
FIG. 11 is a side elevational view of an ignition module comprising another embodiment of the invention, the module being shown in association with a spark plug and engine shroud.
Figure 12:
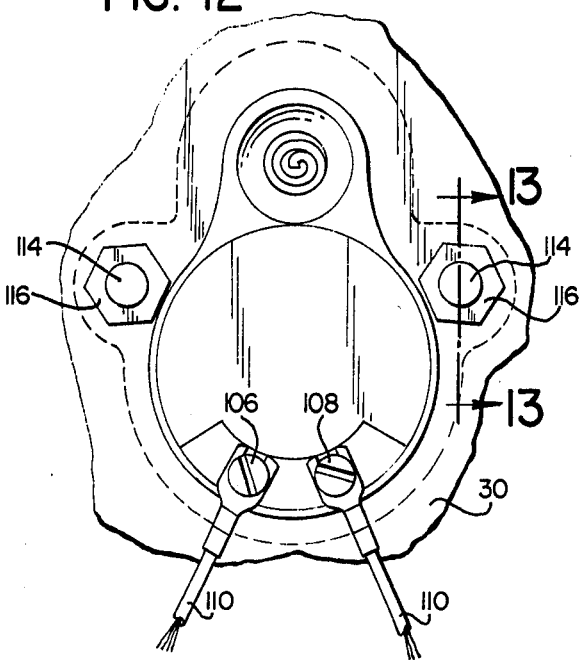
FIG. 12 is a view taken generally on the line 12—12 of FIG. 11 but with the spark plug being shown removed from the module.
Figure 13:
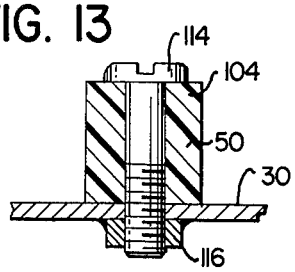
FIG. 13 is a view taken on the line 13—13 of FIG. 12.

Besides the means shown in FIGS. 1 to 10 for making electrical contact between the module 22 and the remainder of the ignition system, various other means may be employed. For example, FIGS. 11 to 13 shown an ignition module comprising another embodiment of this invention and using an alternate electrical connecting means. Likewise, FIGS. 14 and 15 show an ignition module comprising still another embodiment of the invention and utilizing yet another different electrical connection means.

Referring to FIGS. 11 to 13, the ignition module there shown is indicated at 104 and except for the differences hereinafter discussed, is or may be exactly identical to the module 22 previously described. For making electrical connection therewith, the module 104 includes two terminals including screws 106 and 108 by means of which leads 110, 110 may be attached to the module. The two terminal screws 106 and 108 are equivalent to the two contacts 70 and 72 of the module 22 and are connected by internal parts to the primary and secondary windings of the ignition coil in the same manner. Since the leads 110, 110 are connected to the module 104 by the terminal screws 106 and 108, it is not necessary to provide a connector assembly similar to the assembly 34 of FIG. 3 and the module may be mechanically connected to the engine shroud 30 by a simpler means such as the illustrated two screws 114, 114 passing through the housing 50 of the module 104 and threaded into nuts 116, 116 welded or otherwise fixed to the shroud, as shown in FIG. 13.

Figure 14:
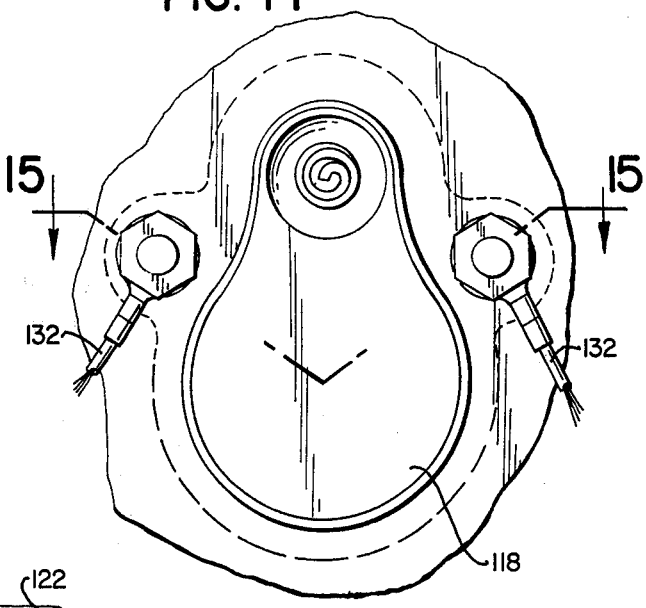
FIG. 14 is a view generally similar to FIG. 12 but illustrating an ignition module comprising another embodiment of this invention.
Figure 15:
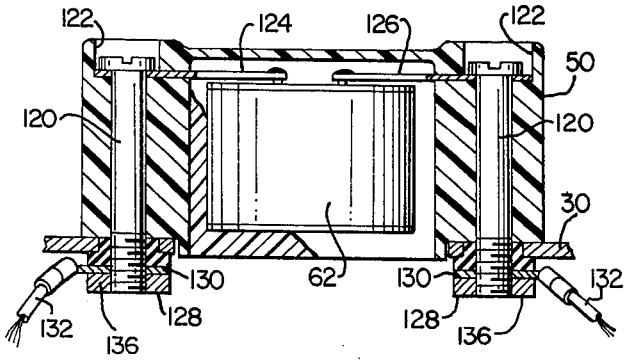
FIG. 15 is a sectional view taken on the line 15—15 of FIG. 14.

FIGS. 14 and 15 show an ignition module 118 wherein the electrical connection between the module and the remainder of the ignition system is automatically made as the module is attached to the engine shroud, but in this case, the electrical connection is made through the fastening screws rather than through separate contacts. Referring to FIGS. 14 and 15, the module 118 is attached to the engine shroud 30 by two screws 120, 120 passing through the housing 50 of the module. The openings in the housing through which the screws 120, 120 pass are counterbored at their outer ends, as indicated at 122, 122 so that the heads of the screws are recessed to prevent accidental contact therewith. The ignition coil 62 has two contacts 124 and 126 each of which extends through the module housing 50 into a respective one of the counterbores 122, 122 so as to be engaged by the head of the screw received therein. The engine shroud 30 in turn, is fitted with two connectors 128, 128 each fixed to the shroud and each including an electrically conductive metallic part 130 which contacts the associated screw 120. Each conductive part 130 is in turn connected with a respective one of two leads 132, 132. The remainder of each connector 128 is made of electrical insulating material 136 so that the screws 120, 120 and the conductive parts 130, 130 are electrically isolated from the shroud 30. Accordingly, it will be understood that electrical connection is made from the leads 132, 132 to the ignition coil 62 of the module through the screws 120, 120 so that when the screws 120, 120 are used to hold the module in place on the shroud, they also serve to make electrical connection with the ignition coil of the module.

I claim:

1. In a device having a self-contained internal combustion engine, the combination comprising: an internal combustion engine having a spark plug an outer end portion of which extends outwardly from the remainder of said engine, a stationary structure other than said engine or spark plug spaced outwardly from said engine in the vicinity of said spark plug, a unitary ignition module, said module having a socket receiving said outer end portion of said plug and said module also including an ignition coil, with a primary winding and a secondary winding, for supplying high-tension voltage to said spark plug, and means removably fixing said module to said stationary structure whereby said module is structurally unsupported by said plug, said socket at all points along the length of said outer end portion of said plug having a transverse cross section substantially larger than that of said plug whereby said plug fits loosely into said socket without contacting the walls of said socket.

2. A device as defined in claim 1 further characterized by a ring of resilient material in said socket, said ring extending between and contacting the wall of said socket and said outer end portion of said plug to provide a seal between said plug and said socket while nevertheless allowing slight movement of said module relative to said plug.

3. In a device having a self-contained internal combustion engine, the combination comprising: an internal combustion engine having a spark plug a portion of which extends outwardly from the remainder of said engine, a shroud housing at least a portion of said engine, said shroud including a thin walled portion thereof spaced outwardly from said engine in the vicinity of said spark plug and located in a plane generally perpendicular to the axis of said spark plug, said thin walled portion of said shroud having an opening through which said spark plug may pass when being assembled with and disassembled from said engine, a unitary ignition module, means removably fixing said module to said thin walled portion of said shroud in the vicinity of said opening whereby said module is structurally unsupported by said plug, said module having a socket receiving the outer end portion of said plug and said module also including an ignition coil, with a primary winding and a secondary winding, for supplying high-tension voltage to said spark plug, said socket at all points along the length of said outer end portion of said plug having a transverse cross section substantially larger than that of said plug whereby said plug fits loosely into said socket without contacting the walls of said socket.

4. The combination defined in claim 3 further characterized by said module including a part in said socket for making electrical connection with the high-tension terminal of said spark plug, and means connecting said part to one end of said secondary winding of said ignition coil.

5. The combination defined in claim 3 further characterized by said module including a generally cup-shaped housing defining a recess in which said socket and said ignition coil are received, said socket being defined by a well member separate from said housing and said well member and said ignition coil being arranged with their axes spaced from and parallel to one another.

6. The combination defined in claim 5 further characterized by a potting material in said recess filling the otherwise empty space therein except for said socket to hold said coil and well member in place relative to said housing.

7. A module for use as part of the ignition system of a spark ignited engine, said module comprising: a generally cup-shaped housing defining a recess, an ignition coil located in said recess and having primary and secondary windings, a well member separate from said housing also located in said recess and defining a socket for receiving the outer end portion of a spark plug, said well member and said ignition coil having axes spaced from and generally parallel to one another, a part in said socket for making electrical connection with the high-tension terminal of a spark plug received in said socket, means for connecting said part to one end of said secondary winding of said ignition coil, terminal means for electrically connecting said coil to other parts of the ignition system with which said module is used, and a potting material in said recess filling the otherwise empty space therein except for said socket to hold said coil and well member in place relative to said housing.

8. A module as defined in claim 7 further characterized by said housing including means adapting it for mounting to a stationary structure other than said spark plug.

9. In a device having a self-contained internal combustion engine, the combination comprising: an internal combustion engine having a spark plug a portion of which extends outwardly from the remainder of said engine, a shroud housing at least a portion of said engine and having a portion spaced outwardly from said engine in the vicinity of said spark plug, said shroud having an opening through which said spark plug may pass when being assembled with and disassembled from said engine, and a unitary ignition module removably fixed to said shroud in the vicinity of said opening, said module including a generally cup-shaped housing defining a two lobed recess, a socket in one of the lobes of said recess, an ignition coil in the other lobe of said recess, said socket receiving the outer end portion of said plug, and said ignition coil having a primary winding and a secondary winding and a core of magnetic material on which said primary and secondary windings are received, the longitudinal axis of said core being arranged parallel to the longitudinal axis of said socket, said module also including a part in said socket for making electrical connection with the high-tension terminal of said spark plug, and means connecting said part to one end of said secondary winding of said ignition coil.

10. A module for use as part of the ignition system of a spark ignited engine, said module comprising: a generally cup-shaped housing defining a recess, an ignition coil located in said recess and having primary and secondary windings, a well member separate from said housing also located in said recess and defining socket for receiving the outer end portion of a spark plug, said housing recess including a lobe in which said well member is received, and said housing including a plurality of ribs spaced angularly around the periphery of said lobe and engaging the outer surface of said well member, a part in said socket for making electrical connection with the hightension terminal of a spark plug received in said socket, means for connecting said part to one end of said secondary winding of said ignition coil, terminal means for electrically connecting said coil to other parts of the ignition system with which said module is used, and a potting material in said recess filling the otherwise empty space therein except for said socket to hold said coil and well member in place relative to said housing.

11. A module for use as part of the ignition system of a spark ignited engine, said module comprising: a generally cup-shaped housing defining a recess, an ignition coil located in said recess and having primary and secondary windings, as well member separate from said housing also located in said recess and defining a socket for receiving the outer end portion of a spark plug, a part in said socket for making electrical connection with the high-tension terminal of a spark plug received in said socket, means for connecting said part to one end of said secondary winding of said ignition coil, terminal means for electrically connecting said coil to other parts of the ignition system with which said module is used, and a potting material in said recess filling the otherwise empty space therein for said socket to hold said coil and well member in place relative to said housing, said well member having an end wall at its inside end spaced from said housing, said part for making electrical connection with the high-tension terminal of a spark plug being a spring, said means for connecting said part to one end of said secondary winding being a strip of conducting material a portion of which is located behind said end wall of said well member, said end wall having an opening and said spring having an end portion extending through said opening to said strip of conductive material, and a quantity of solder connecting said end portion of said spring to said strip, said end portion of said spring, said strip and said quantity of solder effectively sealing said opening in said end wall, said end wall being otherwise imperforate.

* * * * *

UNITED STATES PATENT AND TRADEMARK OFFICE

CERTIFICATE OF CORRECTION

PATENT NO. : 3,935,852

DATED : February 3, 1976

INVENTOR(S) : John J. Donovan and Daniel R. Isham

It is certified that error appears in the above–identified patent and that said Letters Patent are hereby corrected as shown below:

Col. 2, line 18, after "in" (first occurrence), insert --turn--

Col. 5, line 21, "to the housing.50" should read --in the housing 50--

Col. 5, line 44, "if" should read --of--

Col. 8, line 52, "hightension" should read --high-tension--

Col. 8, line 65, "as well" should read --a well--

Col. 9, line 7, after "therein", insert --except--

Col. 10, line 2, "conducting" should read --conductive--

Signed and Sealed this

*sixth* Day of *April 1976*

[SEAL]

*Attest:*

RUTH C. MASON
*Attesting Officer*

C. MARSHALL DANN
*Commissioner of Patents and Trademarks*

Disclaimer 3,935,852.—*John J. Donovan*, West Springfield, and *Daniel R. Isham*, Hampden, Mass. SPARK PLUG CONNECTOR AND IGNITION COIL MODULE FOR ENGINE IGNITION SYSTEM. Patent dated Feb. 3, 1975. Disclaimer filed Feb. 17, 1976, by the assignee, *R. E. Phelon Company, Inc.*

Hereby enters this disclaimer to claim 2 of said patent.

[*Official Gazette May 4, 1976.*]